US012747683B2

(12) United States Patent
Higashi et al.

(10) Patent No.: US 12,747,683 B2
(45) Date of Patent: Sep. 29, 2026

(54) DRY SUMP ENGINE

(71) Applicant: TOYOTA JIDOSHA KABUSHIKI KAISHA, Toyota (JP)

(72) Inventors: Takahiro Higashi, Toyota (JP); Yuya Horii, Toyota (JP); Motohiro Yuge, Toyota (JP); Hirotaka Takeuchi, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/360,499

(22) Filed: Oct. 16, 2025

(65) Prior Publication Data

US 2026/0110256 A1 Apr. 23, 2026

(30) Foreign Application Priority Data

Oct. 22, 2024 (JP) ..... 2024-185741

(51) Int. Cl.

| | |
|---|---|
| ***F01M 13/00*** | (2006.01) |
| ***F01M 11/00*** | (2006.01) |
| ***F01M 11/10*** | (2006.01) |
| ***F01M 13/02*** | (2006.01) |

(52) U.S. Cl.

CPC ..... *F01M 13/0011* (2013.01); *F01M 11/0004* (2013.01); *F01M 11/10* (2013.01); *F01M 13/021* (2013.01); *F01M 2011/0083* (2013.01); *F01M 2013/0038* (2013.01); *F01M 2013/027* (2013.01); *F01M 2250/60* (2013.01)

(58) Field of Classification Search

CPC ..... F01M 13/0011; F01M 11/0004; F01M 11/10; F01M 13/021; F01M 2011/0083; F01M 2013/0038; F01M 2013/027; F01M 2250/60

See application file for complete search history.

(56) References Cited

U.S. PATENT DOCUMENTS

| | | | | |
|---|---|---|---|---|
| 4,674,457 | A * | 6/1987 | Berger | F01M 11/0004 123/196 R |
| 5,568,842 | A * | 10/1996 | Otani | F01M 1/02 123/196 R |
| 2006/0102429 | A1* | 5/2006 | Suzuki | F01M 11/10 123/196 R |
| 2009/0277416 | A1* | 11/2009 | Saito | F01M 11/0004 123/196 AB |
| 2015/0167591 | A1* | 6/2015 | Sato | F01M 11/0004 123/403 |

FOREIGN PATENT DOCUMENTS

| | | |
|---|---|---|
| JP | 2008-038839 A | 2/2008 |
| JP | 2016-135996 A | 7/2016 |

* cited by examiner

*Primary Examiner* — Hoang M Nguyen

(74) *Attorney, Agent, or Firm* — Finnegan, Henderson, Farabow, Garrett and Dunner, LLP

(57) ABSTRACT

A dry sump engine having a simple structure to certainly prevent a pressure rise in an oil tank. In the dry sump engine, a solenoid valve is arranged between the oil tank and a gas receiving section. A controller comprises: a low-pressure determiner that determines whether a pressure in the oil tank is lower than a first reference pressure level; a condition determiner that determines a satisfaction of a predetermined condition; and an open controller that opens the solenoid valve when the internal pressure of the oil tank is lower than the first reference pressure level, or when the predetermined condition is satisfied.

12 Claims, 3 Drawing Sheets

DRY SUMP ENGINE

CROSS-REFERENCE TO RELATED APPLICATIONS

The present disclosure claims the benefit of Japanese Patent Application No. 2024-185741 filed on Oct. 22, 2024 with the Japanese Patent Office, the disclosures of which are incorporated herein by reference in its entirety.

BACKGROUND

Field of the Disclosure

The embodiment of the present disclosure relates to the art of a dry sump engine, and more particularly, to a dry sump engine configured to control an internal pressure of an oil tank.

Discussion of the Related Art

A dry sump engine is provided with an oil tank and a scavenge pump arranged outside the engine. In the dry sump engine, oil in a crankcase is delivered to the oil tank by the scavenge pump, and the oil from which blow-by gas is separated is returned from the oil tank to a crankcase. In order to regulate an internal pressure of the oil tank, the dry sump engine is provided with a PCV (Positive Crankcase Ventilation) valve. Specifically, the PCV valve is arranged between the oil tank and an intake manifold or between the oil tank and a compressor of the supercharger, and the PCV valve opens when the internal pressure of the oil tank rises to return the blow-by gas from the oil tank to an intake section of the engine.

During operation of the engine, a temperature in the crankcase is high and moisture contained in the blow-by gas being delivered from the crankcase to the oil tank is vaporized. However, a piping for flowing the blow-by gas from the oil tank to the intake section of the engine is atmospherically exposed and hence a temperature thereof may be lowered. Therefore, in the situation where an ambient temperature is low, the vapor being delivered to the intake section of the engine together with the blow-by gas may be condensed and frozen in the pipe in which the PCV valve is arranged. If the vapor freezes in the PCV valve, PCV valve will not be opened by the internal pressure of the oil tank. As a result, the internal pressure of the oil tank is raised excessively thereby damaging a sealing member and the oil tank to cause an oil leakage.

Examples of the dry sump engine configured to prevent freezing of a piping for flowing blow-by gas are disclosed in JP-A-2008-038839 and JP-A-2016-135996. In the dry sump engine described in JP-A-2008-038839, a PCV valve is disposed on a site where heat is exchanged between the PCV valve and an oil passage so that the PCV valve is prevented from freezing by the heat of the lubricating oil flowing through the oil passage from the crankcase to the oil tank. On the other hand, the engine described in JP-A-2016-135996 is provided with a freezing preventive structure including a heat receiving passage for heating a blow-by gas arranged in a cylinder head cover. According to the teachings of JP-A-2016-135996, specifically, the blow-by gas delivered from an external oil separating device to an intake system passage is heated by heat in the cylinder head to prevent a blow-by gas pipe from freezing.

Thus, In the dry sump engines described in JP-A-2008-038839 and JP-A-2016-135996, the blow-by gas recirculated from the oil tank to the intake system of the engine is heated by the heat of the lubricating oil or the cylinder head. Therefore, condensation and freezing of moisture contained in the blow-by gas may be prevented. However, in a situation where the engine has been inactivated for a long time or an outside air temperature is extremely low, a temperature of the lubricating oil is not high enough to heat the blow-by gas sufficiently. Likewise, a temperature of the cylinder head is not high enough to heat the blow-by gas sufficiently immediately after the startup of the engine.

Thus, according to the prior arts described in JP-A-2008-038839 and JP-A-2016-135996, it is difficult to avoid the freezing of the PCV valve and the piping for flowing the blow-by gas in the condition where a temperature of the engine is not sufficiently raised.

In addition, an internal pressure of the oil tank may be raised due to a malfunction of the PCV valve or a clogging of the piping for flowing the blow-by gas caused by a freezing of the moisture or a deposit of dust. However, such pressure rise in the oil tank due to factors other than freezing may not be avoided by the teachings of JP-A-2008-038839 and JP-A-2016-135996.

Further, in the dry sump engine described in JP-A-2008-038839, an additional structure is required to arrange the PCV valve close to the oil passage. On the other hand, in the dry sump described in JP-A-2016-135996, the additional intake system passage has to be arranged inside of the cylinder head cover. Therefore, the manufacturing cost and weights of the engines described in those prior art documents are increased by the above-explained modifications.

SUMMARY

The embodiment of the present disclosure has been conceived noting the foregoing technical problems, and it is therefore an object of the present disclosure to provide a dry sump engine having a simple structure to certainly avoid a pressure rise in an oil tank.

According to the exemplary embodiment the present disclosure, there is provided a dry sump engine, comprising: an oil tank holding a lubricating oil and a blow-by gas delivered from a crankcase or an oil pan by a pump; a pipeline for delivering the blow-by gas from the oil tank to an intake section; a PCV valve arranged on the pipeline that is opened when a pressure in the oil tank is raised higher than a pressure in the intake section; a gas receiving section that receives the blow-by gas without leakage; an another valve that is arranged between the oil tank and the gas receiving section; and a controller that controls the another valve. In order to achieve the above-explained objective, according to the exemplary embodiment of the present disclosure, the controller comprises: a low-pressure determiner that is configured to determine whether an internal pressure of the oil tank is lower than a first reference pressure level; a condition determiner that is configured to determine a satisfaction of a predetermined condition other than the condition in which the internal pressure of the oil tank is lower than the first reference pressure level, and an open controller that is configured to open the another valve when the low-pressure determiner determines that the internal pressure of the oil tank is lower than the first reference pressure level, or when the condition determiner determines that the predetermined condition is satisfied.

In a non-limiting embodiment, the predetermined condition may include a condition in which a prediction that the PCV valve will be frozen is made.

In a non-limiting embodiment, the controller may be configured to make a prediction that the PCV valve will be frozen based on a fact that a temperature of an engine cooling water is equal to or lower than a reference temperature level.

In a non-limiting embodiment, the predetermined condition may include a condition in which an internal pressure of the oil tank is equal to or higher than a second reference pressure level.

In a non-limiting embodiment, the dry sump engine may further comprise a supercharger having a compressor that pressurizes an intake air, and the compressor may serve as the gas receiving section.

In a non-limiting embodiment, the another valve may include a solenoid valve that is actuated electrically to be opened and closed.

Thus, according to the exemplary embodiment of the present disclosure, the controller is configured to open the solenoid valve not only when the internal pressure of the oil tank is lower than the first reference pressure level, but also when the predetermined condition is satisfied. As described, the condition determiner determines a satisfaction of the predetermined condition other than the condition in which the internal pressure of the oil tank is lower than the first reference pressure level. Specifically, the predetermined condition includes the condition in which a temperature of the engine cooling water is equal to or lower than the reference temperature level, and the condition in which an internal pressure of the oil tank is equal to or higher than the second reference pressure level. That is, the solenoid valve is opened when the internal pressure of the oil tank is raised, or when the PCV valve is expected to be frozen. According to the exemplary embodiment of the present disclosure, therefore, the internal pressure of the oil tank will not increase excessively, and oil leakage caused by increased pressure in the oil tank may be prevented. In addition, the solenoid valve is opened when the internal pressure of the oil tank decreases to prevent excessive pressure drop in the oil tank, and the solenoid valve is controlled by the controller. According to the exemplary embodiment of the present disclosure, therefore, the dry sump engine adapted to certainly prevent a pressure rise in the oil tank by a simple structure may be realized without requiring additional components.

BRIEF DESCRIPTION OF THE DRAWINGS

Features, aspects, and advantages of exemplary embodiments of the present disclosure will become better understood with reference to the following description and accompanying drawings, which should not limit the disclosure in any way.

DETAILED DESCRIPTION OF THE PREFERRED EMBODIMENT(S)

An embodiment of the present disclosure will now be explained with reference to the accompanying drawings. Note that the embodiments shown below are merely examples of the present disclosure, and do not limit the present disclosure.

Figure 1:
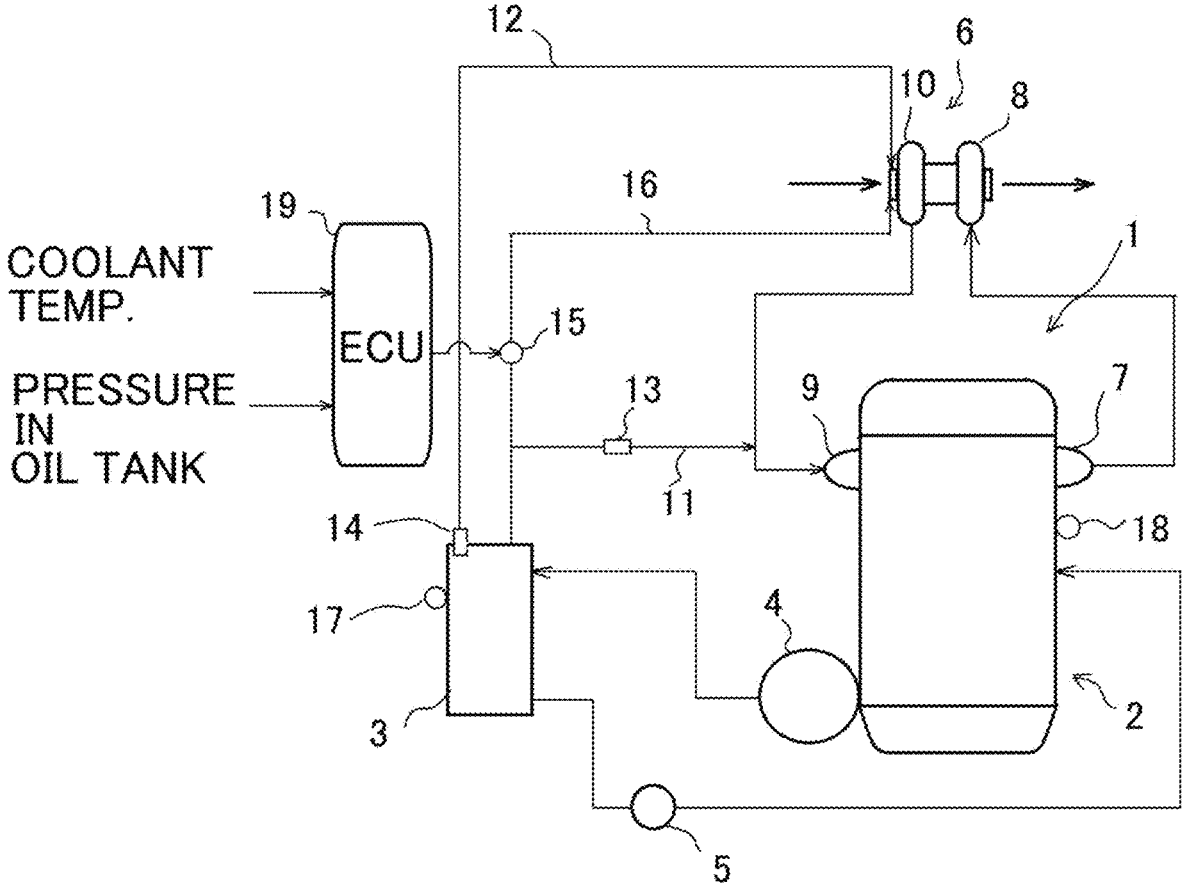
FIG. 1 is a schematic illustration showing a flowing system of a lubricating oil and a blow-by gas according to the exemplary embodiment of the present disclosure.

Referring now to FIG. 1, there is shown one example of a flowing system of a lubricating oil the and a blow-by gas to which an engine 1 according to the exemplary embodiment of the present disclosure is applied. The engine 1 is a dry sump engine in which an oil tank 3 is arranged separately from an engine body 2. As the conventional gasoline engines, the engine body 2 comprises a cylinder block having a plurality of cylinders, a crankcase formed integrally with an oil pan, and a cylinder head. The engine body 2 is cooled by a cooling water such that a temperature thereof is lowered to a predetermined level or lower.

The lubricating oil in the crankcase arranged underneath the engine body 2 is delivered to the oil tank 3 by a scavenge pump 4. The blow-by gas dissolves in the lubricating oil in the crankcase, and hence the blow-by gas separates from the lubricating oil temporarily stored in the oil tank 3. That is, the oil tank 3 also serves as a gas-liquid separator. The oil tank 3 is connected with an oil pump 5 so that the lubricating oil is supplied from the oil tank 3 to the engine 1 by the oil pump 5 in accordance with an operating condition of the engine 1.

The engine 1 shown in FIG. 1 is provided with a supercharger 6 that pressurizes an intake air. For example, a turbocharger driven by an exhaust gas emitted from the engine 1 may be adopted as the supercharger 6. Specifically, the supercharger 6 comprises a turbine 8 driven by the exhaust gas discharged from an exhaust manifold 7, and a compressor 10 that is rotated integrally with the turbine 8 to pressurize air and to supply the pressurized air to the intake manifold 9.

The blow-by gas is recirculated to an intake section of the engine 1. Specifically, the blow-by gas separated from the lubricating oil in the oil tank 3 is returned to the intake manifold 9 or an upstream side thereof through a first return pipe 11, and to an intake section of the compressor 10 through a second return pipe 12. Accordingly, the first return pipe 11 and the second return pipe 12 serve as a pipeline of the present disclosure, and the intake manifold 9 and the compressor 10 serve as a gas receiving section of the present disclosure that receives the blow-by gas and holds the blow-by gas without leakage.

A PCV valve 13 is arranged on the first return pipe 11, and a PCV valve 14 is arranged on the second return pipe 12. The PCV valve 13 is actuated by a pressure difference between the oil tank 3 side and the intake manifold 9 side, and the PCV valve 14 is actuated by a pressure difference between the oil tank 3 side and the intake section of the compressor 10. Specifically, the PCV valve 13 is opened when the pressure in the oil tank 3 is raised higher than the pressure in the intake manifold 9, and the PCV valve 14 is opened when the pressure in the oil tank 3 side is raised higher than the pressure in the intake section of the compressor 10. In addition, the PCV valves 13 and 14 are exposed to air in an engine compartment (not shown). Therefore, the PCV valves 13 and 14 may be frozen by moistures condensed in the first return pipe 11 and the second return pipe 12.

In addition, in order to release a negative pressure from the oil tank 3, a vacuum switching valve 15 as another valve is arranged on a pipe 16 connecting the oil tank 3 to the intake section of the compressor 10. For example, a normally closed solenoid valve that is opened electrically in a specific condition may be adopted as the vacuum switching valve 15. In order to collect data for controlling the vacuum switching valve 15, a pressure sensor 17 that detects a pressure in the oil tank 3 is arranged in the oil tank 3, and a temperature sensor 18 that detects a temperature of the outside air or a temperature of the engine cooling water is arranged in the engine body 2.

The vacuum switching valve 15 is controlled by a controller 19 based on the data collected by various sensors including the pressure sensor 17 and the temperature sensor 18. Specifically, the controller 19 is an electronic control unit (referred to as ECU in FIG. 1) comprising a microcomputer including an arithmetic element (CPU), a storage element (RAM, ROM), and an interface. The controller 19 is configured to perform calculation using a program prepared in advance based on incident data transmitted from the sensors including the pressure sensor 17 and the temperature sensor 18 as well as data stored in advance. The calculation result is transmitted from the controller 19 in the form of a command signal. The data stored in advance in the controller 19 includes a reference pressure level and a reference temperature level used to determine levels of a pressure and a temperature.

Figure 2:
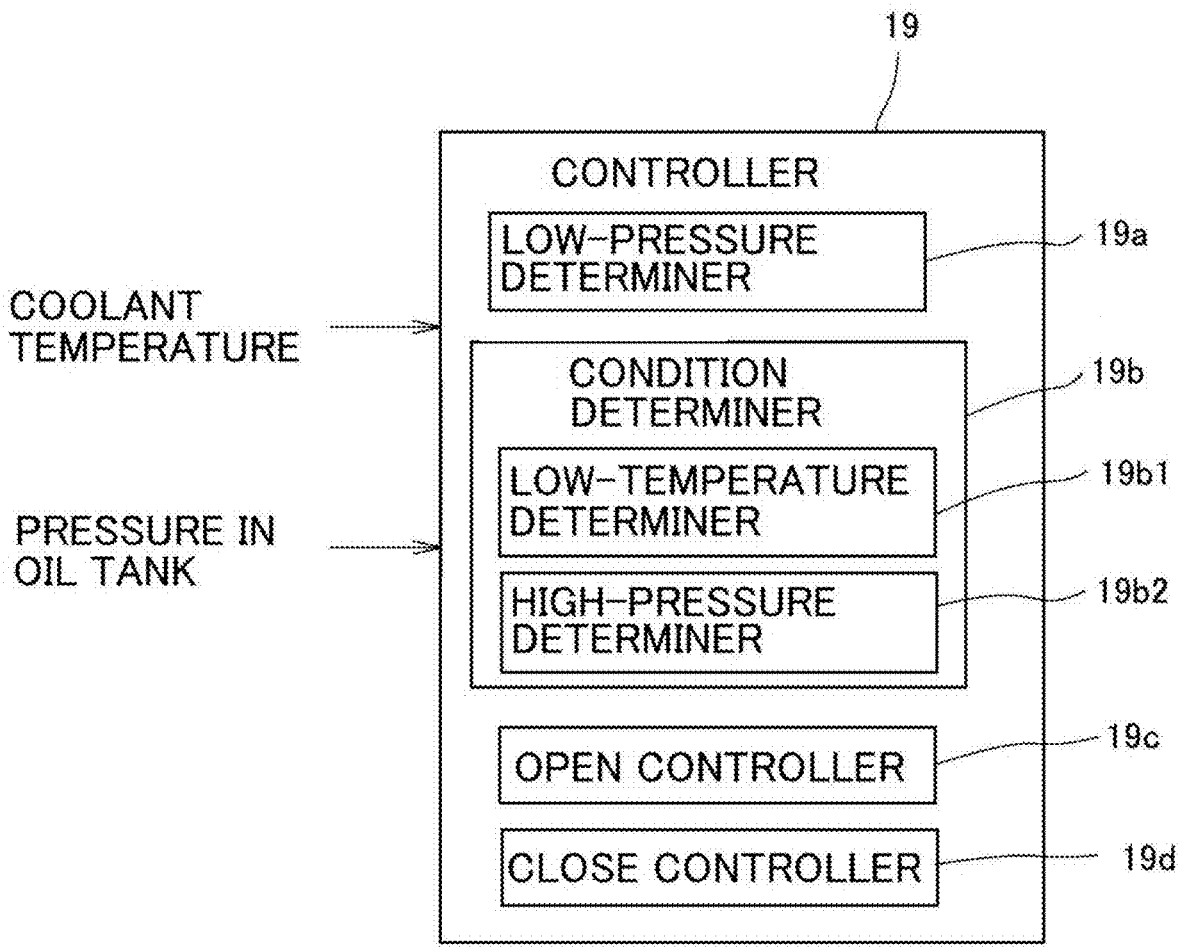
FIG. 2 is a block diagram showing functions of a controller according to the exemplary embodiment of the present disclosure.

Functions of the controller 19 to control the vacuum switching valve 15 are shown in FIG. 2. As shown in FIG. 2, the controller 19 includes a low-pressure determiner 19*a*, a condition determiner 19*b*, an open controller 19*c*, and a close controller 19*d*. The low-pressure determiner 19*a* is configured to determine whether an internal pressure of the oil tank 3 detected by the pressure sensor 17 is equal to or lower than a low reference pressure level as a first reference pressure level. To this end, a comparator may be adopted as the low-pressure determiner 19*a*.

The condition determiner 19*b* is configured to determine a satisfaction of a predetermined condition other than a condition in which the internal pressure of the oil tank 3 is equal to or lower than the low reference pressure level. According to the exemplary embodiment of the present disclosure, the predetermined condition includes a condition in which a temperature of the engine cooling water or the outside air detected by the temperature sensor 18 is equal to or lower than the reference temperature level, and a condition in which the internal pressure of the oil tank 3 detected by the pressure sensor 17 is equal to or higher than a high reference pressure level as a second reference pressure level. Therefore, in order to determine satisfactions of the above-mentioned conditions, the condition determiner 19*b* includes a low-temperature determiner 19*b*1 and a high-pressure determiner 19*b*2.

The open controller 19*c* is configured to transmit a command signal for opening the vacuum switching valve 15, and the close controller 19*d* is configured to transmit a command signal for closing the vacuum switching valve 15.

Figure 3:
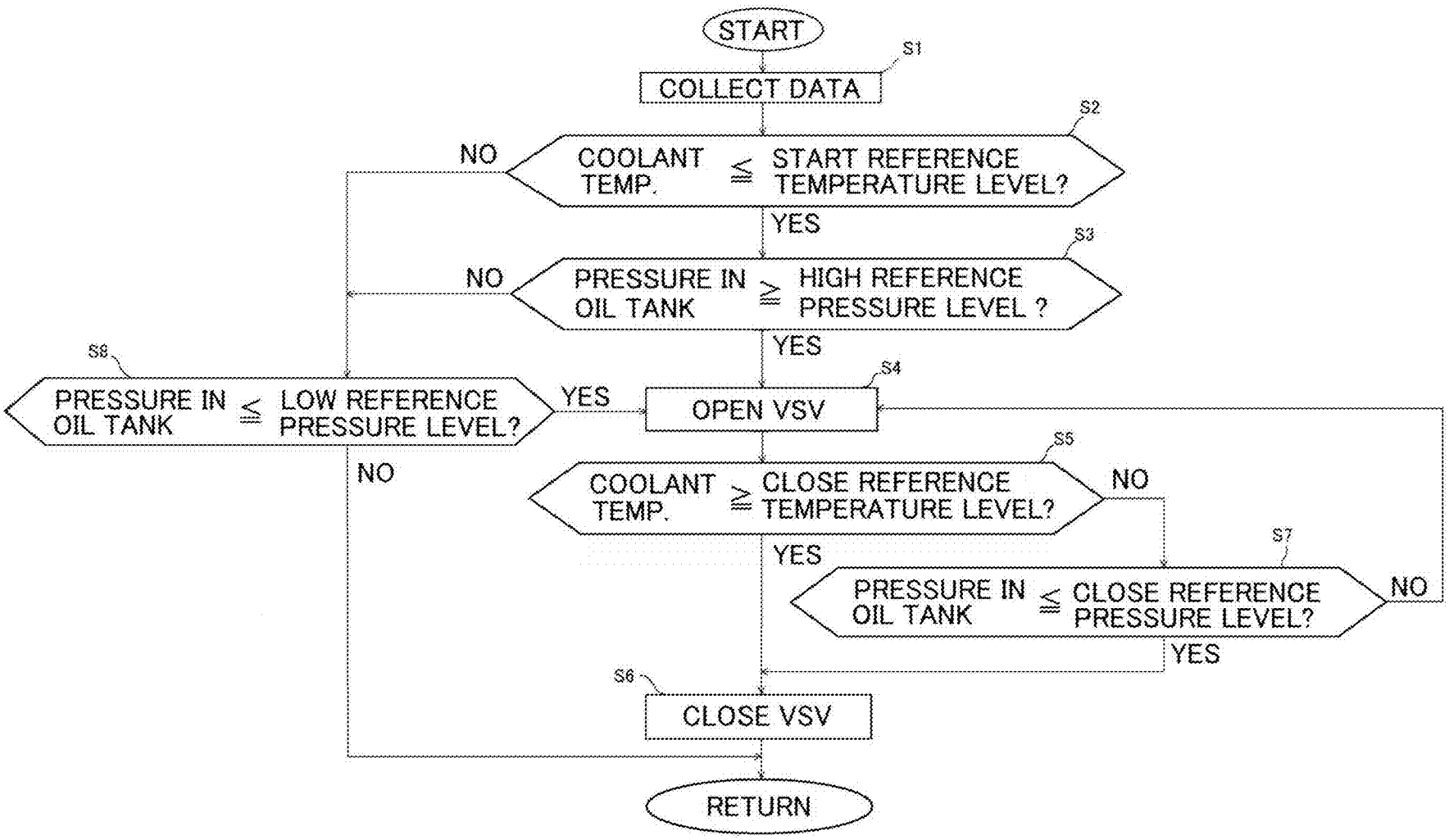
FIG. 3 is a flowchart showing one example of a routine executed by a controller.

Next, an example of a routine executed by the controller 19 to control the vacuum switching valve 15 will be described with reference to FIG. 3. The routine shown in FIG. 3 is commenced immediately before starting the engine 1. For example, the routine illustrated in FIG. 3 is started when a ready switch (not shown) is turned ON. First of all, at step S1, data including a temperature of the engine cooling water and an internal pressure of the oil tank 3 is collected.

Then, at step S2, it is determined whether or not a temperature of the engine cooling water is equal to or lower than a start reference temperature level. That is, at step S2, the condition determiner 19*b* makes predictions whether the PCV valves 13 and 14 and the return pipes 11 and 12 will be frozen. For this purpose, the start reference temperature level is set to about 0 degree C. If the answer of the step S2 is YES, the routine progresses to step S3 to determine whether the internal pressure of the oil tank is equal to or higher than the high reference pressure level. Specifically, the high reference pressure level is set to a level to which the internal pressure of the oil tank will not be raised during normal operation of the engine 1, and at which an abnormality such as oil leakage from the oil tank 3 will not be caused.

Thus, at steps S2 and S3, satisfactions of the above-explained predetermined conditions are determined. If the answers of both of the steps S2 and S3 are YES, the routine progresses to step S4 to open the vacuum switching valve 15. As a result, the oil tank 3 is communicated with the compressor 10 so that the internal pressure of the oil tank 3 is equalized with the pressure in the intake section of the compressor 10. Therefore, even if the PCV valve 13 or 14 cannot be opened due to freezing or deposition, the internal pressure of the oil tank 3 will not be raised excessively thereby preventing leakage of oil therefrom.

Thereafter, a control for closing the vacuum switching valve 15 is executed. To that end, the routine progresses to step S5 to confirm that the PCV valves 13 and 14 are not frozen. At step S5, specifically, it is determined whether or not the temperature of the engine cooling water is equal to or higher than a close reference temperature level. For example, the close reference temperature level is set to about 10 degrees C. If the answer of step S5 is YES, the routine progresses to step S6 to close the vacuum switching valve 15, and thereafter returns.

By contrast, if the answer of step S5 is NO, the routine progresses to step S7 to determine whether the internal pressure of the oil tank 3 is equal to or lower than a close reference pressure level. The close reference pressure level is set to a level at which a malfunction of the oil tank 3 will not occur taking account of hysteresis, and the close reference pressure level is lower than the above-mentioned high reference pressure level. If the answer of step S7 is YES, the routine progresses to step S6 to close the vacuum switching valve 15, and thereafter returns. Thus, in a case that the PCV valves 13 and 14 will not be frozen or in a case that the internal pressure of the oil tank 3 is not excessively high, the vacuum switching valve 15 being opened is closed. By contrast, if the answers of both of step S5 and step S7 are NO, that is, in a case that the conditions to open the vacuum switching valve 15 have not yet been eliminated, the routine returns to step S4 to keep the vacuum switching valve 15 to open.

Whereas, if the answer of step S2 or S3 is NO, the vacuum switching valve 15 is controlled in a normal manner. In those cases, the routine progresses to step S8 to determine whether the internal pressure of the oil tank 3 is equal to or lower than the low reference pressure level by the low-pressure determiner 19*a*. For example, given that the engine 1 has idled for a certain period of time immediately before stopping the engine 1, an air intake to the engine 1 is restricted. Consequently, the pressure in the intake manifold 9 drops thereby lowering the internal pressure in the oil tank 3. In this situation, if the internal pressure of the oil tank 3 is excessively lowered, the engine 1 is not allowed to start smoothly. Therefore, in order to start the stopping engine 1 smoothly, the negative pressure is released. To this end, the low reference pressure level is set to a level at which the stopping engine 1 may be restarted without hindrance.

If the answer of step S8 is YES, the routine progresses to step S4 to open the vacuum switching valve 15. In this case, the engine 1 has already been activated and the temperature of the engine 1 has already been raised. Therefore, the routine further progresses from step S5 to step S6 so that the vacuum switching valve 15 is closed immediately. If the negative pressure in the oil tank 3 is not released sufficiently by thus opening and closing the vacuum switching valve 15 within a short period of time, the vacuum switching valve 15 may be maintained to open for a predetermined period of time by executing an extra timer control after opening the vacuum switching valve 15. By contrast, if the answer of step S8 is NO, the routine returns. In this case, since the normally closed type valve is adopted as the vacuum switching valve 15, the vacuum switching valve 15 remains closed.

As described above, the vacuum switching valve 15 opens to introduce air when the internal pressure of the oil tank 3 drops during normal operation of the engine 1. According to the exemplary embodiment of the present disclosure, specifically, the vacuum switching valve 15 is opened to release pressure from the oil tank 3 when the internal pressure of the oil tank 3 is high. That is, according to the exemplary embodiment of the present disclosure, the vacuum switching valve 15 has a function of releasing the negative pressure and a function of releasing the high pressure. Therefore, the dry sump engine may be manufactured without requiring additional components, and the structure of the dry sump engine may be simplified. In addition, a manufacturing cost of the dry sump engine may be reduced.

Although the above exemplary embodiments of the present disclosure have been described, it will be understood by those skilled in the art that the present disclosure should not be limited to the described exemplary embodiments, and various changes and modifications can be made within the scope of the present disclosure. For example, in the foregoing embodiment, the vacuum switching valve 15 is opened in the case that the temperature of the engine cooling water is equal to or lower than the start reference temperature level and that the internal pressure of the oil tank is equal to or higher than the high reference pressure level. Nonetheless, the vacuum switching valve 15 may also be opened when the temperature of the engine cooling water is equal to or lower than the start reference temperature level, or when the internal pressure of the oil tank is equal to or higher than the high reference pressure level. Otherwise, the vacuum switching valve 15 may also be opened when the outside air temperature is equal to or lower than the reference temperature level. Further, a section other than the intake section of the compressor and the intake manifold where the blow-by gas may be held without leakage may also be adopted as the gas receiving section.

What is claimed is:

1. A dry sump engine, comprising:

an oil tank holding a lubricating oil and a blow-by gas delivered from a crankcase or an oil pan by a pump;

a pipeline for delivering the blow-by gas from the oil tank to an intake section;

a PCV valve arranged on the pipeline that is opened when a pressure in the oil tank is raised higher than a pressure in the intake section;

a gas receiving section that receives the blow-by gas without leakage;

an another valve that is arranged between the oil tank and the gas receiving section; and a controller that controls the another valve, wherein the controller comprises a low-pressure determiner that is configured to determine whether an internal pressure of the oil tank is lower than a first reference pressure level, a condition determiner that is configured to determine a satisfaction of a predetermined condition other than the condition in which the internal pressure of the oil tank is lower than the first reference pressure level, and an open controller that is configured to open the another valve when the low-pressure determiner determines that the internal pressure of the oil tank is lower than the first reference pressure level, or when the condition determiner determines that the predetermined condition is satisfied.

2. The dry sump engine as claimed in claim 1, wherein the predetermined condition includes a condition in which a prediction that the PCV valve will be frozen is made.

3. The dry sump engine as claimed in claim 2, wherein the controller is configured to make the prediction that the PCV valve will be frozen based on a fact that a temperature of an engine cooling water is equal to or lower than a reference temperature level.

4. The dry sump engine as claimed in claim 1, wherein the predetermined condition includes a condition in which the internal pressure of the oil tank is equal to or higher than a second reference pressure level.

5. The dry sump engine as claimed in claim 1, further comprising:

a supercharger having a compressor that pressurizes an intake air, wherein the compressor serves as the gas receiving section.

6. The dry sump engine as claimed in claim 2, further comprising:

a supercharger having a compressor that pressurizes an intake air, wherein the compressor serves as the gas receiving section.

7. The dry sump engine as claimed in claim 3, further comprising:

a supercharger having a compressor that pressurizes an intake air, wherein the compressor serves as the gas receiving section.

8. The dry sump engine as claimed in claim 4, further comprising:

a supercharger having a compressor that pressurizes an intake air, wherein the compressor serves as the gas receiving section.

9. The dry sump engine as claimed in claim 1, wherein the another valve includes a solenoid valve that is actuated electrically to be opened and closed.

10. The dry sump engine as claimed in claim 2, wherein the another valve includes a solenoid valve that is actuated electrically to be opened and closed.

11. The dry sump engine as claimed in claim 3, wherein the another valve includes a solenoid valve that is actuated electrically to be opened and closed.

12. The dry sump engine as claimed in claim 4, wherein the another valve includes a solenoid valve that is actuated electrically to be opened and closed.

* * * * *